US007323828B2

(12) United States Patent
Russell et al.

(10) Patent No.: US 7,323,828 B2
(45) Date of Patent: Jan. 29, 2008

(54) LED CURRENT BIAS CONTROL USING A STEP DOWN REGULATOR

(75) Inventors: Anthony G. Russell, San Jose, CA (US); Chris B. Bartholomeusz, San Francisco, CA (US)

(73) Assignee: Catalyst Semiconductor, Inc., Santa Clara, CA (US)

( * ) Notice: Subject to any disclaimer, the term of this patent is extended or adjusted under 35 U.S.C. 154(b) by 0 days.

(21) Appl. No.: 11/114,516

(22) Filed: Apr. 25, 2005

(65) Prior Publication Data

US 2006/0238174 A1 Oct. 26, 2006

(51) Int. Cl.
*H05B 41/36* (2006.01)

(52) U.S. Cl. ..... 315/291; 315/224; 315/247

(58) Field of Classification Search ..... 315/224, 315/307; 327/124, 530; 323/282
See application file for complete search history.

(56) References Cited

U.S. PATENT DOCUMENTS 3,736,495 A * 5/1973 Calkin et al. ..... 323/286
3,754,182 A * 8/1973 Morris et al. ..... 323/299
5,359,280 A * 10/1994 Canter et al. ..... 323/282
5,959,443 A * 9/1999 Littlefield ..... 323/287
6,667,583 B2 12/2003 Kerenyi
6,888,383 B1 * 5/2005 Fairbanks ..... 327/124
6,943,504 B1 * 9/2005 York ..... 315/224
7,030,596 B1 * 4/2006 Salerno et al. ..... 323/282
2005/0270003 A1 * 12/2005 Floyd et al. ..... 323/282

OTHER PUBLICATIONS

Supertex Inc., HV9921/22 Initial Release: "3-Pin Switch-Mode LED Lamp Driver IC", 2005, 10 pgs.

* cited by examiner

*Primary Examiner*—Douglas W. Owens
*Assistant Examiner*—Chuc Tran
(74) *Attorney, Agent, or Firm*—Bever, Hoffman & Harms, LLP; E. Eric Hoffman, Esq.

(57) ABSTRACT

A step down switching regulator circuit that is particularly well-suited to drive high power LEDs includes a crossover conduction mode (XCM) control circuit that maintains operation at the crossover point between continuous conduction mode (CCM) and discontinuous conduction mode (DCM). This XCM operation provides an inductor current waveform that ramps up and down between zero and a desired maximum current. One or more comparators in the XCM control circuit can be used to control switching between the inductor current ramp up and ramp down phases. In this manner, complex feedback loop logic and PID controlled PWM signal generation logic can be avoided, and the need for external sense resistors and associated interface pins can be eliminated.

21 Claims, 5 Drawing Sheets

LED CURRENT BIAS CONTROL USING A STEP DOWN REGULATOR

BACKGROUND OF THE INVENTION

1. Field of the Invention

The invention relates to the field of electronic circuits, and in particular, to a circuit for providing accurate current bias control for light emitting diode applications.

2. Related Art

A light emitting diode (LED) is a diode that emits photons in response to a current flow between its anode and cathode. LEDs are often used in modern lighting applications due to their durability, efficiency, and small size compared to other light sources. The range of applications for which LEDs are appropriate is continually increasing due to development of increasingly higher efficiency and higher output LEDs. For example, many types of automotive lighting elements (e.g., interior lights, external signal lights) are being updated with LED sources.

To properly power the LEDs in these high-power applications (i.e., applications in which a significant voltage difference exists between the load voltage (e.g., roughly 3.6V for a white LED) and the input supply voltage (e.g., roughly 12V for an automobile battery)), "step-down" or "buck" switching regulators are typically used. A switching regulator uses the input voltage to rapidly pulse energy into a storage element (typically an inductor), and that stored energy is then transferred into the load element (e.g., an LED). This switching methodology causes the total load current to ramp up and down between maximum and minimum current levels. A small filter capacitor at the output can be included to smooth out the current ramps to provide a constant load current into the LED. Switching regulation is therefore well-suited to driving an LED, since the light output of the LED in response to this switching behavior will be observed as a constant light output, with the actual output level of the LED being determined by the average current provided to the LED.

FIG. 1A shows a conventional step-down switching regulator circuit 100 for driving an LED D110. Circuit 100 is a buck circuit that converts a high input voltage VBATT (e.g., a 12V battery voltage) down to the desired LED drive voltage (e.g., 3.6V for a white LED) while providing a desired average drive current. Switching regulator circuit 100 includes a sense resistor R150, LED D110, an inductor L120, and a switching transistor Q140 coupled in series between a supply voltage VBATT and ground. An output capacitor C160 is coupled between supply voltage VBATT and the junction between LED D110 and inductor L120, while a Schottky diode S130 is coupled between supply voltage VBATT and the output terminal of inductor L120 (i.e., the downstream terminal of inductor L120 coupled to transistor Q140). Finally, a proportional-integral-derivative (PID) controller 101 includes inputs coupled across sense resistor R150, an input coupled to the junction between inductor L120 and Schottky diode S130, and an output coupled to the gate of switching transistor Q140.

To drive LED D110, PID controller 101 monitors the current through LED D110 by measuring the voltage drop across sense resistor R150 (which is proportional to the current through LED D110), while at the same time measuring the changing voltage at the junction between inductor L120 and Schottky diode S130. In response to the detected load (LED) current, PID generator 101 provides a pulse width modulated (PWM) control signal PWM1 to the gate of transistor Q140. Control signal PWM1 provides a square wave input signal that switches between a logic HIGH level and a logic LOW level to turn transistor Q140 on and off, respectively. Turning on and off transistor Q140 causes inductor L120 to charge and discharge to provide the desired average load current to LED D110. Meanwhile, capacitor C160 acts as a filter for this switching behavior to provide a relatively constant output voltage across LED D110.

Thus, to describe the operation of switching regulator circuit 100 in detail, when control signal PWM1 is in a logic HIGH state, transistor Q140 is turned on, and an electrical path is provided between supply voltage VBATT and ground. Current begins to flow though LED D110 and charges the magnetic field in inductor L120. As inductor L120 charges up, a current I_IND through inductor L120 (and hence, through LED D110) increases. Since supply voltage VBATT is a DC voltage, current I_IND increases linearly at a rate equal to the voltage across inductor L120 divided by the inductance of inductor L120. For example, if supply voltage VBATT is 12V, and the forward voltage of LED D110 is 3V, the voltage impressed across inductor L120 is 9V (12V−3V). Therefore, if inductor L120 has an inductance L, the rate at which current I_IND increases is 9V/L.

When control signal PWM1 switches to a logic LOW state, transistor Q140 is turned off and the voltage across inductor L120 immediately changes to a value required to maintain the level of inductor current I_IND. For example, using the above example (supply voltage VBATT=12V and LED D110 Vf=3V), the input terminal of inductor L120 (i.e., the upstream terminal of inductor L120 connected to LED D110) will be maintained at 9V. Therefore, the output terminal of inductor L120 will jump to the value of supply voltage VBATT plus the forward voltage of Schottky diode S130. If Schottky diode S130 has a forward voltage of 0.2V, the output terminal of inductor L120 immediately after switching transistor Q140 is turned off will be 12.2V (12V plus 0.2V).

Thus, immediately after transistor Q140 is turned off, inductor L120 begins discharging through Schottky diode S130 into supply voltage VBATT, thereby maintaining current flow through LED D110. However, because the current flow during this phase of the switching cycle is generated by the magnetic field stored in inductor L120, current I_IND decreases as that magnetic field dissipates. Because the voltage across inductor L120 is maintained at a relatively constant level during this discharge phase, current I_IND decreases at a linear rate that is once again equal to the voltage across inductor L120 divided by the inductance of inductor L120. For example, if VBATT is equal to 12V, and the forward voltage of LED D110 is equal to 3V, the input terminal of inductor L120 will be at 9V (12V minus 3V), while the output terminal of inductor L120 will be at 12.2V (if Schottky diode S130 has a forward voltage of 0.2V). Therefore, the voltage across inductor L120 will be 3.2V (12.2V minus 9V), and the rate at which I_IND decreases is 3.2V/L.

Conventional switching mode regulators operate either in continuous current mode (CCM) or discontinuous conduction mode (DCM). In CCM operation, inductor current I_IND cycles between two non-zero current values. FIG. 1B shows a sample graph GC of inductor current I_IND over time for CCM operation. Graph GC ramps up and down between a minimum current IC_MIN and a maximum current IC_MAX. Because of the linearly increasing and decreasing profile of graph GC, the average current IC_AVG is simply the average of maximum current IC_MAX and minimum current IC_MIN, as indicated below:

$$IC_AVG=(IC_MAX+IC_MIN)/2 \quad \text{[EQ. 1]}$$

Note that this average current determination is independent of the relative slopes of the ramp up and ramp down portions of the waveform for inductor current I_IND.

During DCM operation, the inductor current is allowed to fall to zero for a portion of the discharge cycle. In other words, the magnetic field in the inductor is allowed to collapse, so that current no longer flows through inductor L120 (and hence LED D110). After a period of time, control signal PWM1 turns transistor Q140 back on, and current I_IND begins increasing from zero. FIG. 1C shows a sample graph GD of inductor current I_IND over time for this DCM operation. Graph GD initially ramps from zero to a maximum current ID_MAX, and then ramps back down to zero, remaining at zero for an offtime duration D. The average current ID_AVG for DCM operation is therefore equal to half of the maximum current ID_MAX scaled by the proportion of time inductor current I_IND is at a non-zero value, as indicated below:

$$ID_AVG=(ID_MAX/2)*(1-D/T) \quad \text{[EQ. 2]}$$

where T is the period of the current waveform (i.e., the time between successive peaks).

As noted above, the output of an LED is determined by the average current supplied to the LED. Therefore, the accurate generation of average current IC_AVG during CCM operation and the accurate generation of average current ID_AVG during CCM operation are important for proper LED function. Unfortunately, accurate average current control for either CCM or DCM operation can be extremely complicated. For example, when switching regulator circuit 100 (in FIG. 1A) is operating in CCM mode, the values of maximum current IC_MAX and minimum current IC_MIN are determined by the duty cycle of control signal PWM1. Specifically, the logic HIGH portion of each cycle of control signal PWM1 must be long enough for inductor current I_IND to ramp from minimum current IC_MIN to maximum current IC_MAX, while the logic LOW portion of each cycle must be long enough for inductor current I_IND to ramp down from current IC_MAX to current IC_MIN. However, due to variations in operational characteristics (e.g., the actual value of supply voltage VBATT, the actual forward voltage of LED D110, and the actual inductance of inductor L120 will all vary to some degree from circuit to circuit), additional circuitry must be used to measure the actual value of inductor current I_IND generated in response to the switching control. Furthermore, the feedback loop resulting from such additional current monitoring circuitry can require sophisticated control to properly regulate the resulting control signal PWM1. Typically, a PID controller (e.g., PID controller 100) is used, which further increases implementation complexity and cost. Similar drawbacks apply to the use of DCM mode, with even greater difficulties due to the addition of the off-time period during each cycle (i.e., offtime duration D in FIG. 1C).

Another issue for conventional switching regulator circuits (such as circuit 100) is that monitoring the load current to allow proper functioning of a PID controller requires that a sense resistor be placed in-line with the LED. The sense resistor must be relatively large to minimize unnecessary power consumption, and is therefore typically external to the switching regulator circuit. However, this external placement then mandates that the packaging for the switching regulator circuit include additional pins to enable measurement of the voltage across the sense resistor. The resulting increase in pin count can preclude the use of smaller, more desirable chip packaging for conventional switching regulator ICs.

Accordingly, it is desirable to provide a simple switching regulator that can be easily configured to provide an accurate average load current.

SUMMARY OF THE INVENTION

Conventional switching regulator circuits require complex current monitoring circuitry and feedback control logic to generate a desired average load current. By using a simple control circuit to maintain the conduction mode at the crossover point between continuous conduction mode and discontinuous conduction mode, the average load current can be easily predicted, thereby eliminating the need for a PWM control signal and attendant current monitoring circuitry. Furthermore, by operating at this crossover conduction mode (XCM) in which the minimum load current is zero, the average current delivered by a switching regulator operated in this manner is simply a function of the maximum inductor current. Therefore, only the maximum inductor current need be defined to cause the switching regulator circuit to provide a desired average load current, thereby greatly simplifying configuration requirements.

In one embodiment, a step down switching regulator can be operated such that the inductor current provided to a load (such as an LED) varies between zero and a specified maximum current. During a charging phase of operation, an inductor in series with the load is connected between an upper and lower supply voltage, so that as the inductor charges, the current through the inductor (and hence the current through the load) increases linearly. Upon detecting that the inductor current has reached a desired maximum level, the circuit between the upper and lower supply voltages is broken (i.e., the inductor is disconnected from one of the supply voltages), and the inductor discharges through a bypass Schottky diode that creates a loop between the inductor and the load. As the inductor discharges, the inductor current decreases linearly from the maximum current. Upon detecting that the inductor current has reached zero, the circuit between the upper and lower supply voltages is completed (i.e., the inductor is reconnected to the supply voltage) so that the current begins increasing as the inductor charges.

In one embodiment, the indication to break the circuit between the upper supply voltage and the lower supply voltage (i.e., switch to discharging mode) can be provided by a "stop cycle" control circuit that detects the maximum desired inductor current by monitoring the voltage drop across a switching control circuit that breaks/completes the circuit between the upper and lower supply voltages. By determining a resistance for the switching control circuit (e.g., a resistance for a switching transistor in the switching control circuit), the threshold voltage drop across the switching control circuit when the load current is at a desired maximum level can be calculated. When that voltage drop across the switching control circuit reaches that threshold voltage, the stop cycle control circuit can instruct the switching control circuit to break the circuit between the upper and lower supply voltages and switch to the discharging phase of operation.

In another embodiment, the indication to complete the circuit between the upper supply voltage and the lower supply voltage can be provided by a "start cycle" control circuit that detects the point at which the inductor current falls to zero by monitoring the biasing state of the bypass Schottky diode. During discharging phase of operation, the Schottky diode is forward biased by the inductor to allow the load current to continue flowing. However, once the magnetic field in the inductor collapses, the Schottky diode falls out of forward biasing and the load current drops to zero. When the start cycle control circuit detects the Schottky diode falling out of forward biasing, the start cycle control circuit can instruct the switching control circuit to complete the circuit between the upper and lower supply voltages to switch back to the charging phase of operation.

In one embodiment, the start and stop cycle control circuits described above can be implemented using comparators and one shots. During the discharging phase, a comparator in the start cycle control circuit can generate a rising edge when the voltage at the junction between the Schottky diode and the inductor rises (or falls, depending on the circuit) to the supply voltage coupled to the Schottky diode. This rising edge signal generated by that comparator can be converted by a one shot in the start cycle control signal into a "start" pulse signal. The start pulse can then be provided to a latch in the switching control circuit to set the output of the latch to a level that turns on a switching transistor to complete the circuit between the upper and lower supply voltages, thereby resuming the charging phase of operation.

Meanwhile, a comparator in the stop cycle control circuit can generate a rising edge when the voltage at the junction between the Schottky diode and the inductor reaches a threshold value during the charging phase (indicating that a desired maximum load current has been reached). That rising edge signal can be converted by a one shot in the stop cycle control circuit to a "stop" pulse signal. The stop pulse can then be provided to the latch in the switching control circuit to set the output of the latch to a level that turns off the switching transistor and breaks the circuit between the upper and lower supply voltages, thereby resuming the discharging phase of operation.

The invention will be more fully understood in view of the following description and drawings.

DETAILED DESCRIPTION

Conventional switching regulator circuits require complex current monitoring circuitry and feedback control logic to generate a desired average load current. By using a simple control circuit to maintain the conduction mode at the crossover point between continuous conduction mode and discontinuous conduction mode, the average load current can be easily predicted, thereby eliminating the need for a PWM control signal and attendant current monitoring circuitry can be eliminated. Furthermore, by operating at this crossover conduction mode (XCM) in which the minimum load current is zero, the average current delivered by a switching regulator operated in this manner is simply a function of the maximum inductor current. Therefore, only the maximum inductor current need be defined to cause the switching regulator circuit to provide a desired average load current, thereby greatly simplifying configuration requirements.

Figure 2A:
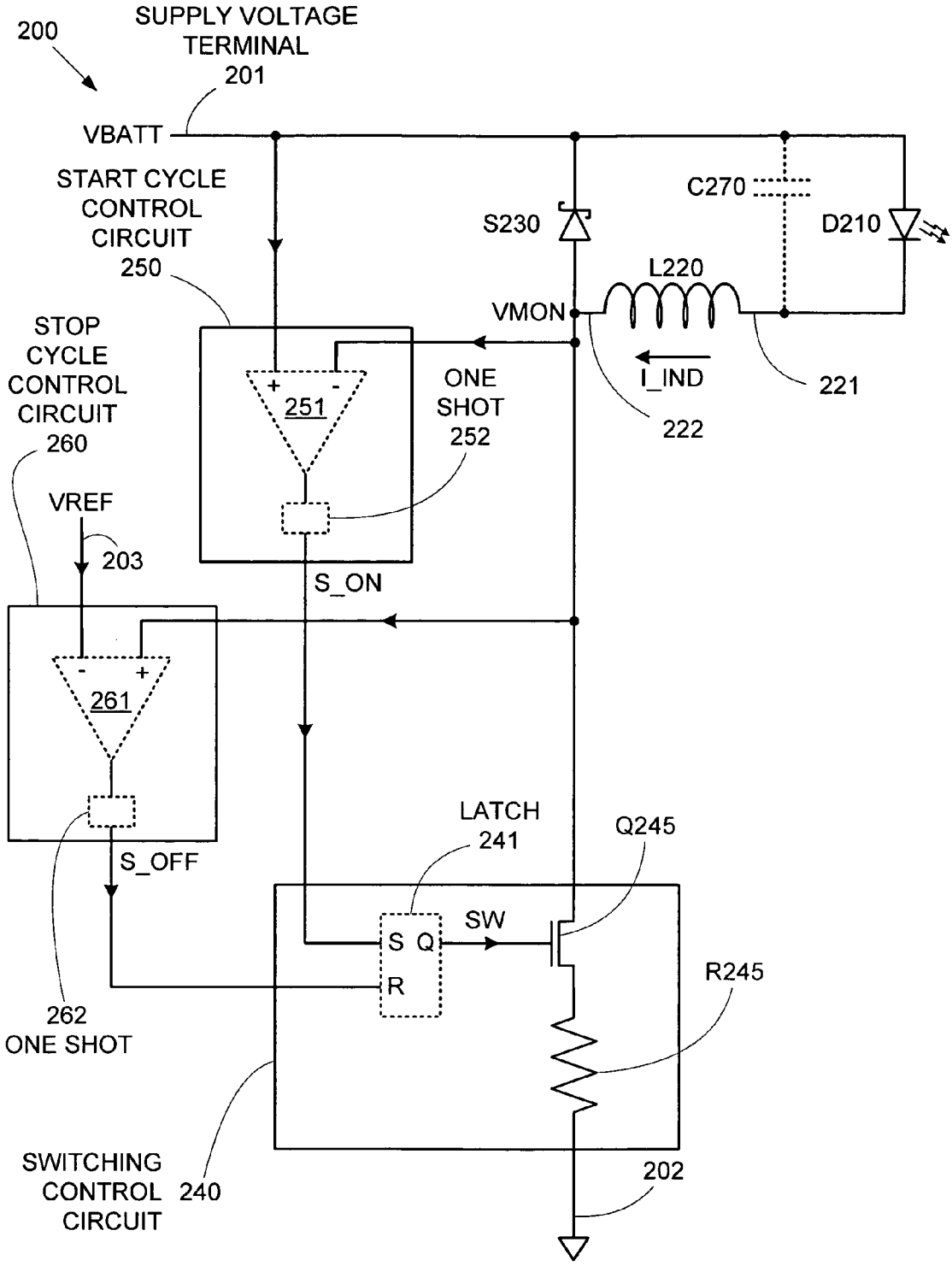
FIG. 2A is a circuit diagram of a switching regulator circuit that incorporates crossover conduction mode (XCM) regulation circuitry.

FIG. 2A shows a circuit diagram of a step down switching regulator circuit 200 for driving an LED D210. Note that the operation of switching regulator circuit 200 is described with respect to driving LED D210 for exemplary purposes only. LED D210 could be replaced with any other type of load requiring a particular average current.

Switching regulator circuit 200 includes an inductor L220, a Schottky diode S230, a switching control circuit 240, a start cycle control circuit 250, a stop cycle control circuit 260, and an optional output capacitor C270. LED D210, inductor L220, and switching control circuit 240 are coupled in series between a supply voltage terminal 201 (coupled to receive a supply voltage VBATT) and a supply voltage terminal 202 (coupled to ground), with the anode and cathode of LED D210 being connected to supply voltage terminal 201 and inductor L220, respectively. Output capacitor C270 (if present) is coupled across LED D210, while Schottky diode S230 is coupled between the output terminal 222 of inductor L220 (i.e., the downstream terminal of inductor L220) and supply voltage terminal 201 (the anode and cathode of Schottky diode S230 are connected to inductor L220 and supply voltage terminal 201, respectively). Meanwhile, the inputs of start cycle control circuit 250 are coupled to supply voltage terminal 201 and output terminal 222 of inductor L220 and the inputs of stop cycle control circuit 260 are coupled to output terminal 222 of inductor L220 and a reference input terminal 203 (coupled to receive a reference voltage VREF). Finally, the outputs of start cycle control circuit 250 and stop cycle control circuit 260 are coupled to the inputs of switching control circuit 240.

Figure 1A:
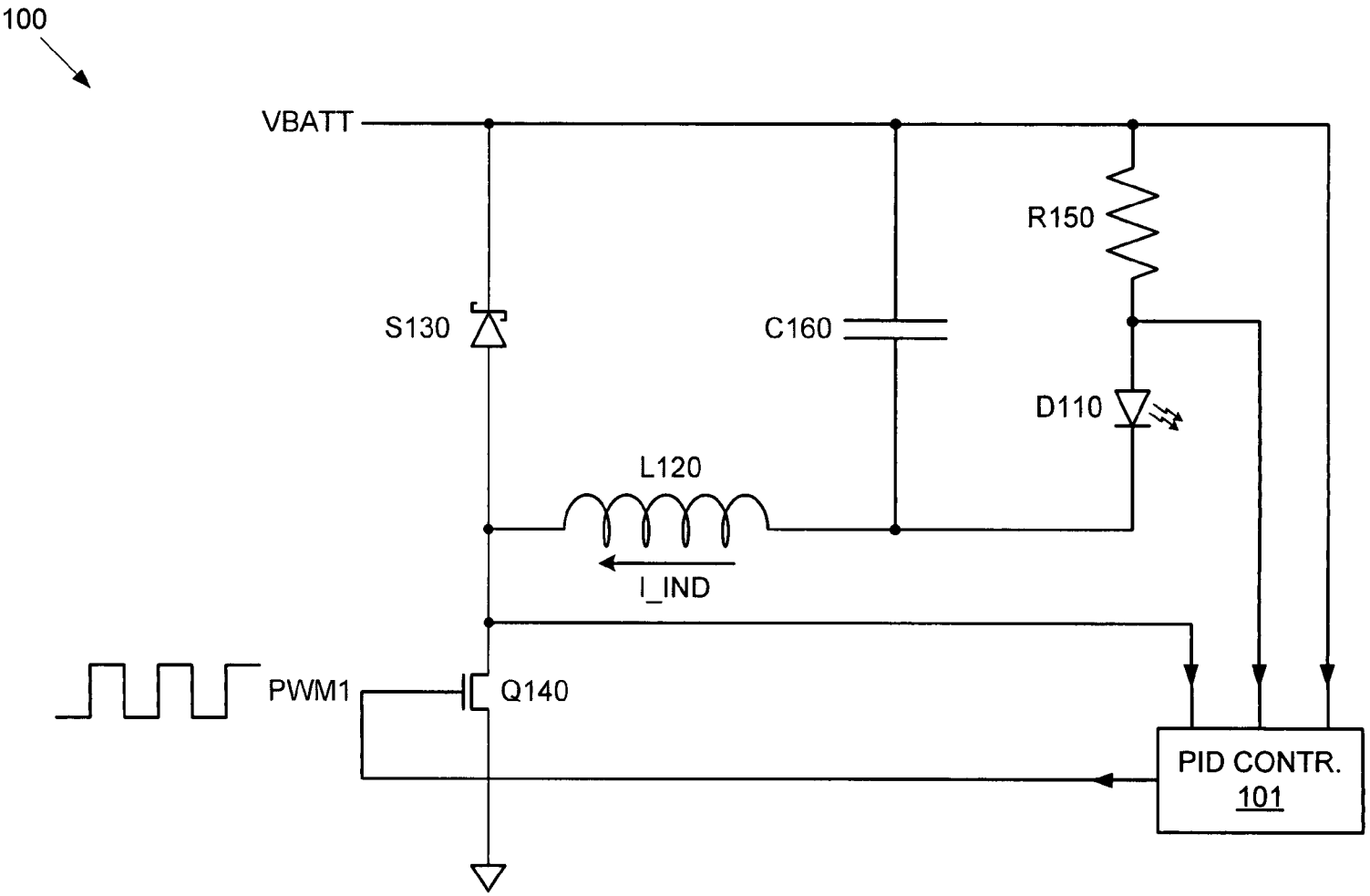
FIG. 1A (PRIOR ART)
FIG. 1A is a circuit diagram of a conventional switching regulator circuit.
Figure 1B:
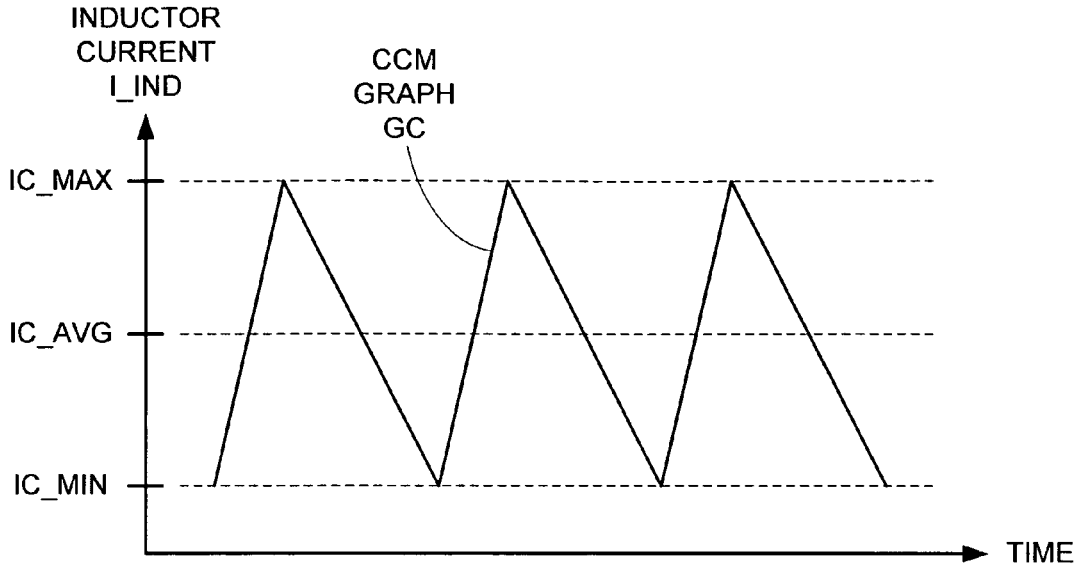
FIG. 1B (PRIOR ART)
FIGS. 1B and 1C are graphs of current waveforms for CCM and DCM modes of operation for a switching regulator circuit.
Figure 1C:
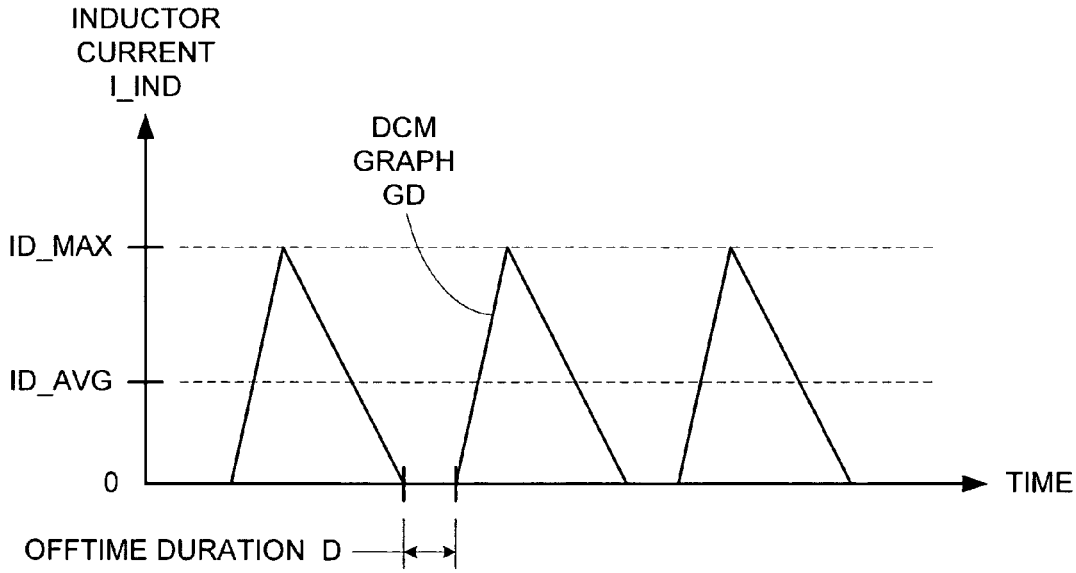
FIG. 1C (PRIOR ART)

Switching control circuit 240 includes circuitry for making and breaking the connection between supply voltage terminal 202 and inductor L220. For exemplary purposes, this switching capability is provided by a NMOS transistor Q245 in switching control circuit 240 that is coupled between the output of inductor L220 and supply voltage terminal 202 (the resistance of transistor Q245 is indicated by resistor R245). However, any other type of switching element (or circuit) could be used. When switching control circuit 240 turns on transistor Q245 to complete the circuit between supply voltage terminals 201 and 202 by connecting supply voltage terminal 202 to inductor L220, a current I_IND begins to flow through inductor L220 (and hence through LED D210) as the magnetic field in inductor L220 charges. As described above with respect to FIG. 1A, during this "charging" phase of operation for switching regulator circuit 200, inductor current I_IND increases linearly at a rate proportional to the voltage across inductor L220 divided by the inductance of inductor L220.

When stop cycle control circuit 260 detects that inductor current I_IND has reached a desired maximum current, stop cycle control circuit 260 generates a stop signal S_OFF that causes switching control circuit 240 to turn off transistor Q245, thereby terminating the charging phase of operation (and initiating the discharging phase of operation, described in greater detail below). In one embodiment, stop cycle control circuit 260 can perform this maximum current detection by monitoring a voltage VMON at output terminal 222 of inductor L220. Voltage VMON increases as inductor current I_IND increases, since the increased inductor current I_IND increases the voltage drop across transistor Q245 (due to the resistance R245 of transistor Q245). Note that resistance R245 will typically be very small, so that the small current-related changes in voltage VMON will not significantly affect the linearity of the waveform for inductor current I_IND. Stop cycle control circuit 260 can compare voltage VMON to a reference voltage VREF that is selected to correspond to the expected value of voltage VMON when inductor current I_IND is equal to the desired maximum current level. For example, in one embodiment, reference voltage VREF can be determined by multiplying the desired maximum value for inductor current I_IND by the "on" resistance of switching transistor Q245. In this manner, the maximum value of current I_IND can be set by supplying an appropriate reference voltage VREF to stop cycle control circuit 260.

When switching control circuit 240 breaks the connection between inductor L220 and supply voltage terminal 202 (thereby breaking the circuit between supply voltage terminals 201 and 202), inductor L220 attempts to resist any change in current I_IND by immediately raising voltage VMON at its output terminal 222 to supply voltage VBATT plus the forward voltage of Schottky diode S230. For example, for a supply voltage VBATT equal to 12V and Schottky diode S230 having a forward voltage of 0.2V, in response to switching control circuit 240 disconnecting inductor L220 from supply voltage terminal 202, inductor L220 would immediately raise voltage VMON to 12.2V (12V plus 0.2V), thereby allowing current I_IND to continue to flow (in the loop formed by LED D210, inductor L220, and Schottky diode S230).

During this "discharging" phase of operation for switching regulator circuit 200, current I_IND is driven by the magnetic field stored in inductor L220. Therefore, current I_IND decreases linearly as inductor L220 discharges. When start cycle control circuit 250 detects that inductor current I_IND has fallen to zero, start cycle control circuit 250 generates a start signal S_ON that causes switching control circuit 240 to turn on transistor Q245, thereby terminating the discharging phase of operation and resuming the charging phase. In one embodiment, start cycle control circuit 250 can perform this "zero current" detection by monitoring voltage VMON at output terminal 222 of inductor L220. Voltage VMON falls to supply voltage VBATT when the magnetic field in inductor L220 collapses and current I_IND falls to zero. Thus, by generating start signal S_ON when voltage VMON reaches supply voltage VBATT, start cycle control circuit 250 can provide accurate control over the switching point from the discharging phase to the charging phase for proper XCM operation. If present, capacitor C270 provides output voltage filtering as the operation of circuit 200 switches back and forth between charging and discharging phases, thereby allowing a more stable load voltage to be provided across LED D210.

In this manner, start cycle control circuit 250, stop cycle control circuit 260, and switching control circuit 240 form an overall regulator control circuit that connects inductor L220 to supply voltage terminal 202 when inductor current I_IND falls to zero, and breaks the connection between inductor L220 and supply voltage terminal 202 when inductor current I_IND reaches a desired maximum current. In one embodiment, start cycle control circuit 250 can comprise any circuit for generating start signal S_ON when Schottky diode S230 drops out of forward bias (e.g., when voltage VMON drops to the level of supply voltage VBATT), stop cycle control circuit 260 can comprise any circuit for generating stop signal S_OFF when the voltage drop across switching circuit rises to a threshold level (e.g., when voltage VMON rises to the level of reference voltage VREF), and switching control circuit 240 can comprise any circuit that connects and disconnects inductor L220 and supply voltage terminal 202 in response to signals S_ON and S_OFF, respectively.

For example, start cycle control circuit 250 and stop cycle control circuit 260 can include comparators 251 and 261, respectively, that feed one shots 252 and 262, respectively. One shots 252 and 262 feed the set terminal and the reset terminal, respectively, of a SR latch 241 in switching control circuit 240, with the output of latch 241 driving the gate of switching transistor Q245. Then, by properly configuring comparators 251 and 261, switching control circuit 240 can be controlled such that switching regulator circuit 200 switches from its charging phase of operation to its discharging phase of operation when the current through diode D210 is equal to zero, and switches from discharging to charging operation when the current through diode D210 reaches a desired maximum current.

For example, the non-inverting and inverting inputs of comparator 251 can be coupled to supply voltage terminal 201 and output terminal 222 of inductor L220, respectively. One-shot 252 is configured to generate start signal S_ON as a logic HIGH pulse in response to a rising edge at the output of comparator 251. The only time comparator 251 will generate a rising edge output is when the magnetic field of inductor L220 collapses (i.e., when Schottky diode S230 falls out of forward biasing and terminal 222 of inductor L220 falls to supply voltage VBATT). At this point, inductor L220 can no longer supply any current through LED D210. Therefore, one shot 252 will only pulse signal S_ON when current I_IND reaches zero. The logic HIGH pulse of signal S_ON can then be provided to SR latch 241 in switching control circuit 240 to switch the output of SR latch 241 to a logic HIGH level, thereby turning on switching transistor Q245. In this manner, start cycle control circuit 250 can switch the operation of switching regulator circuit 200 from the discharging phase to the charging phase when the current through LED D210 reaches zero.

Meanwhile, the non-inverting input and the inverting input of comparator 261 can be coupled to output terminal 222 of inductor L220 and reference voltage terminal 203, respectively. One shot 262 is configured to generate stop signal S_OFF as a logic HIGH pulse in response to a rising edge at the output of comparator 261. The only time comparator 261 will generate a rising edge is when current I_IND is high enough to raise the voltage drop across switching transistor Q245 to the level of reference voltage VREF; i.e., when the desired maximum current through inductor L220 is reached. Therefore, one shot 262 will only pulse signal S_OFF when current I_IND reaches a desired maximum level. The logic HIGH pulse of signal S_OFF can then be provided to the reset terminal of latch 241 to switch the output of latch 241 to a logic LOW level, thereby turning off switching transistor Q245. In this manner, stop cycle control circuit 260 can switch the operation of switching regulator circuit 200 from the charging phase to the discharging phase when the current through inductor L220 reaches a desired maximum current.

Thus, switching control circuit 240, start cycle control circuit 250, and stop cycle control circuit 260 effectively "clock" the operation of switching regulator circuit 200, thereby generating a periodic current waveform through inductor L220 that linearly ramps up and down between zero and a desired maximum current. This mode of operation can be designated crossover conduction mode (XCM) operation, as it falls between conventional CCM and DCM modes of operation. Unlike conventional switching regulator circuits (such as circuit 100 in FIG. 1A), switching regulator circuit 200 does not require any complex PWM generation logic or feedback control logic to provide this XCM mode of operation. Furthermore, XCM operation eliminates the need for an external sense resistor in line with LED D210, thereby minimizing the number of pins required in any chip packaging for switching regulator circuit 200.

Figure 2B:
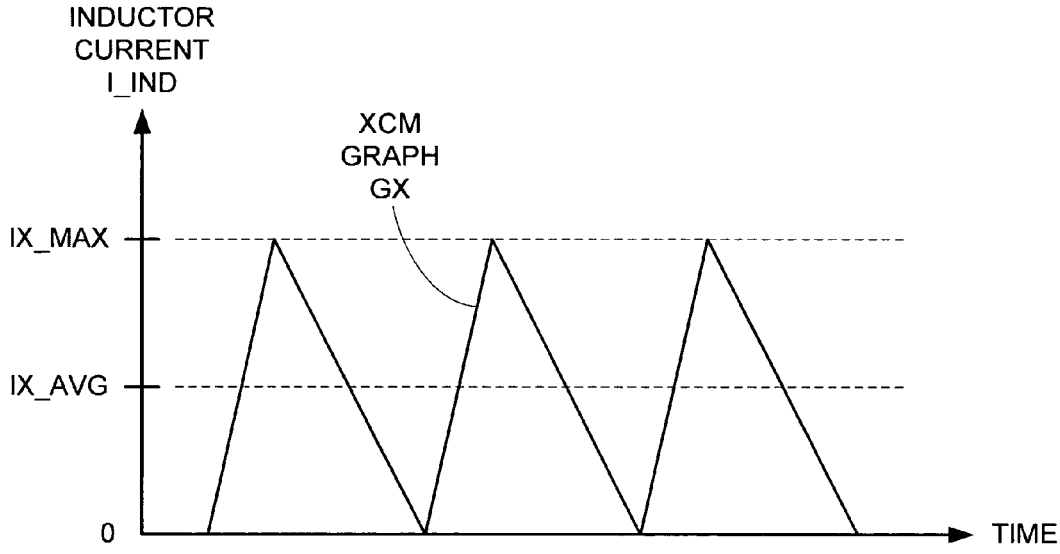
FIG. 2B is a graph of a current waveform for XCM operation for a switching regulator circuit.

FIG. 2B shows an exemplary XCM graph GX that could be generated by switching regulator circuit 200 shown in FIG. 2A. Graph GX ramps up and down between a current of zero to a maximum current IX_MAX. Because the minimum current for graph GX is zero, the average current IX_AVG delivered to LED D210 is simply one half of maximum current IX_MAX, as indicated below:

$$IX_AVG = IX_MAX/2 \quad \text{[EQ. 3]}$$

As described above with respect to FIG. 2A, maximum current IX_MAX is determined by reference voltage VREF. Therefore, switching regulator circuit 200 can be easily configured to provide any desired average current IX_AVG to LED D210 by simply providing an appropriate reference voltage VREF. Note that due to device operational tolerances within switching regulator circuit 200, the transition from charging phase to discharging phase (i.e., the bottom of the "valleys" in graph GX) may not occur exactly and instantly at zero. For example, start cycle control circuit 250 could detect that inductor current I_IND has fallen to zero slightly before or after that event actually occurs. However, such small deviations from the ideal XCM profile depicted in FIG. 3B will typically not result in significant performance degradation. For example, the average current supplied to an LED must typically change by at least 10% before any visually detectable change in light output can be observed.

Figure 3:
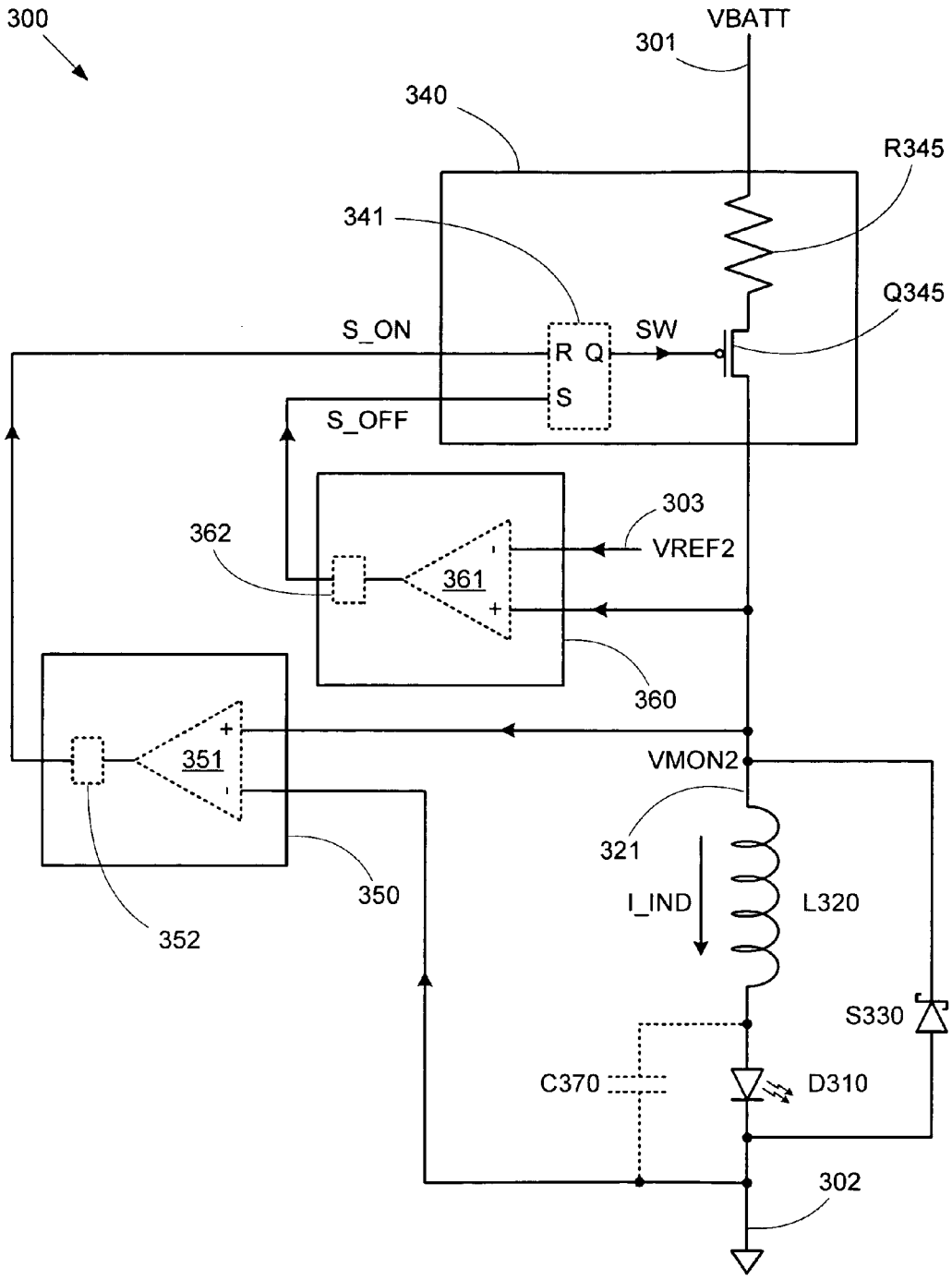
FIG. 3 is a circuit diagram of another switching regulator circuit that incorporates XCM regulation circuitry.

Note that various switching regulator circuits for generating an XCM waveform (as shown in FIG. 2B) will be readily apparent. For example, FIG. 3 shows a step down switching regulator circuit 300 that provides XCM operation by switching at the high supply voltage, rather than at the lower supply voltage (as in switching regulator circuit 300 in FIG. 3A). FIG. 3 shows a circuit diagram of a switching regulator circuit 300 for driving an LED D210. Note that the operation of switching regulator circuit 300 is described with respect to driving LED D310 for exemplary purposes only. LED D310 could be replaced with any other type of load requiring a controllable average current.

Switching regulator 300 includes an inductor L320, a Schottky diode S330, a switching control circuit 340, a start cycle control circuit 350, a stop cycle control circuit 360, and an optional output capacitor C370. Switching control circuit 340, inductor L320, and LED D310 are coupled in series between a supply voltage terminal 301 (coupled to receive a supply voltage VBATT) and a supply voltage terminal 302 (coupled to ground), with the anode and cathode of LED D310 being connected to inductor L320 and supply voltage terminal 302, respectively. Output capacitor C370 (if present) is coupled across LED D310, while Schottky diode S330 is coupled between supply voltage terminal 302 and the input terminal 321 of inductor L320 (i.e., the upstream terminal of inductor L320), with the anode and cathode of Schottky diode S330 being connected to supply voltage terminal 302 and inductor L320, respectively. Meanwhile, the inputs of start cycle control circuit 350 are coupled to supply voltage terminal 302 and input terminal 321 of inductor L320 and the inputs of stop cycle control circuit 360 are coupled to input terminal 321 of inductor L320 and a reference input terminal 303 (coupled to receive a reference voltage VREF2). Finally, the outputs of start cycle control circuit 350 and stop cycle control circuit 360 are coupled to the inputs of switching control circuit 340.

Switching control circuit 340 includes circuitry for making and breaking a connection between inductor L320 and supply voltage terminal 301. For exemplary purposes, this switching capability is provided by a PMOS transistor Q345 in switching control circuit 340 that is coupled between supply voltage terminal 302 (the resistance of transistor Q345 is indicated by resistor R245) and input terminal 321 of inductor L320. However, any other type of switching element (or circuit) could be used.

When switching control circuit 340 turns on transistor Q345 to connect supply voltage terminal 301 and inductor L320, a current I_IND begins flowing through inductor L320 (and hence through LED D310) as the magnetic field in inductor L320 charges (i.e., charging phase of operation). Stop cycle control circuit 360 can monitor this inductor current to determine when the desired maximum current has been reached (e.g., by monitoring the voltage drop across switching control circuit 340). For example, reference voltage VREF2 can be defined as supply voltage VBATT minus the product of the desired maximum current and the resistance of transistor Q345 (i.e., R345). Stop cycle control circuit 360 can then compare a voltage VMON2 at input terminal 321 of inductor L320 to reference voltage VREF2, and instruct switching control circuit 340 to turn off transistor Q345 when voltage VMON2 rises to the level of voltage VREF2 (by issuing stop signal S_OFF).

When transistor Q345 is turned off to break the connection between supply voltage terminal 301 and inductor L320, inductor L320 attempts to resist any change in current I_IND by immediately pulling voltage VMON2 below ground by the forward voltage of Schottky diode S330. For example, for a Schottky diode S330 having a forward voltage of 0.2V, inductor L320 would pull voltage VMON2 down to −0.2V (ground minus 0.2V) in response to transistor Q345 being turned off, thereby allowing current I_IND to continue to flow (in the loop formed by inductor L320, LED D310, and Schottky diode S330).

During this discharging phase of operation, current I_IND is supplied by the magnetic field stored in inductor L320. As inductor L320 discharges, current I_IND decreases linearly until the magnetic field in inductor L320 collapses, and current I_IND falls to zero. At this point, Schottky diode S330 falls out of forward biasing and voltage VMON2 returns to ground. When start cycle control circuit 350 detects that current I_IND has fallen to zero (e.g., by detecting that voltage VMON2 has risen back to ground), start cycle control circuit 350 generates a start signal S_ON. Start signal S_ON instructs switching control circuit to turn transistor Q345 back on, and current I_IND begins rising again as inductor L320 charges. If present, capacitor C370 provides output voltage filtering as the operation of circuit 300 switches between charging and discharging phases, thereby allowing a more stable load voltage to be provided across LED D310.

Thus, start cycle control circuit 350, stop cycle control circuit 360, and switching control circuit 340 form an overall regulator control circuit for switching regulator circuit 300 that connects supply voltage terminal 301 to inductor L320 when inductor current I_IND falls to zero, and breaks the connection between supply voltage terminal 301 and inductor L320 when inductor current I_IND reaches a desired maximum current, thereby providing XCM operation. In one embodiment, start cycle control circuit 350 can comprise any circuit for generating start signal S_ON when Schottky diode S330 drops out of forward bias, stop cycle control circuit 360 can comprise any circuit for generating stop signal S_OFF when the voltage drop across switching circuit rises to a threshold level, and switching control circuit 340 can comprise any circuit that connects and disconnects supply voltage terminal 301 and inductor L320 in response to signals S_ON and S_OFF, respectively.

For example, start cycle control circuit 350 and stop cycle control circuit 360 can include comparators 351 and 361, respectively, that feed one shots 352 and 362, respectively. In turn, one shots 352 and 362 feed the reset terminal and the set terminal, respectively, of a SR latch 341 in switching control circuit 340, with the output of latch 341 driving the gate of switching transistor Q345. By properly configuring comparators 351 and 361, switching control circuit 340 can be controlled such that switching regulator circuit 300 switches from its charging phase of operation to its discharging phase of operation when the current through diode D310 falls to zero, and switches from discharging to charging operation when the current through diode D310 rises a desired maximum current.

For example, the inverting and non-inverting inputs of comparator 351 can be coupled to supply voltage terminal 302 and input terminal 321 of inductor L320, respectively. One-shot 352 is configured to generate start signal S_ON as a logic HIGH pulse in response to a rising edge at the output of comparator 351. The only time comparator 351 will generate a rising edge output is when the magnetic field of inductor L320 collapses (i.e., when Schottky diode S330 falls out of forward biasing and the voltage at terminal 321 of inductor L320 rises to ground). At this point, inductor L320 can no longer supply any current through LED D310. Therefore, one shot 352 will only pulse signal S_ON when current I_IND reaches zero. The logic HIGH pulse of signal S_ON can then be provided to SR latch 341 in switching control circuit 340 to switch the output of SR latch 341 to a logic LOW level, thereby turning on switching transistor Q345. In this manner, start cycle control circuit 350 can switch the operation of switching regulator circuit 300 from the discharging phase to the charging phase when the current through inductor L320 reaches zero.

Meanwhile, the non-inverting input and the inverting input of comparator 361 can be coupled to input terminal 321 of inductor L320 and reference voltage terminal 303, respectively. One shot 362 is configured to generate stop signal S_OFF as a logic HIGH pulse in response to a rising edge at the output of comparator 361. The only time comparator 361 will generate a rising edge is when current I_IND is high enough to raise the voltage drop across switching transistor Q345 to the level of reference voltage VREF2; i.e., when the desired maximum current through LED D310 is reached. Therefore, one shot 362 will only pulse signal S_OFF when current I_IND reaches the desired maximum level. The logic HIGH pulse of signal S_OFF can then be provided to the set terminal of latch 341 to switch the output of latch 341 to a logic HIGH level, thereby turning off switching transistor Q345. In this manner, stop cycle control circuit 360 can switch the operation of switching regulator circuit 300 from the charging phase to the discharging phase when the current through inductor L320 reaches a desired maximum current.

Thus, switching control circuit 340, start cycle control circuit 350, and stop cycle control circuit 360 effectively "clock" the operation of switching regulator circuit 300, thereby operating switching regulator circuit 300 in the XCM mode of operation. Like switching regulator circuit 200 shown in FIG. 2A, switching regulator circuit 300 eliminates the need for PWM generation logic or feedback control logic (and any external sense resistors) to provide this XCM mode of operation, while allowing simple definition of an average current for LED D310 (i.e., by setting an appropriate value for reference voltage VREF2).

Although the present invention has been described in connection with several embodiments, it is understood that this invention is not limited to the embodiments disclosed, but is capable of various modifications that would be apparent to one of ordinary skill in the art. For example, variable voltage sources could be included to provide reference voltages VREF and VREF2 in FIGS. 2A and 3, respectively, to allow the average currents provided to LEDs S230 and S330, respectively, to be varied (e.g., for adjusting output lighting color). Thus, the invention is limited only by the following claims.

The invention claimed is:

1. A switching regulator for providing an average current to a load, the switching regulator comprising:

an inductor; and a crossover conduction mode (XCM) control circuit for charging and discharging the inductor to supply the average current to the load, wherein the XCM control circuit is configured to immediately begin charging the inductor upon detecting that a current through the inductor has fallen to zero; and wherein the XCM control circuit begins discharging the inductor upon detecting that the current through the inductor has reached a predetermined maximum current, wherein the predetermined maximum current is equal to twice the average current.

2. A switching regulator for providing an average current to a load, the switching regulator comprising:

a first voltage supply terminal;

a second voltage supply terminal;

a Schottky diode coupled between a first terminal of the inductor and the first voltage supply terminal;

an inductor; and a crossover conduction mode (XCM) control circuit for charging and discharging the inductor to supply the average current to the load, wherein the XCM control circuit is configured to immediately begin charging the inductor upon detecting that a current through the inductor has fallen to zero, and wherein the XCM control circuit begins discharging the inductor upon detecting that the current through the inductor has reached a predetermined maximum current, and wherein the XCM control circuit makes a connection between the first terminal of the inductor and the second voltage supply terminal to charge the inductor, and wherein the XCM control circuit breaks a connection between the first terminal of the inductor and the second voltage supply terminal to discharge the inductor.

3. The switching regulator of claim 2, wherein when the inductor is charging, the Schottky diode is forward biased, and wherein the XCM control circuit comprises:

a switching control circuit for making and breaking the connection between the first terminal of the inductor and the second voltage supply terminal; and a start cycle control circuit for instructing the switching control circuit to make the connection between the first terminal of the inductor and the second voltage supply terminal when the Schottky diode falls out of forward biasing.

4. The switching regulator of claim 3, wherein the XCM control circuit further comprises a stop cycle control circuit for instructing the switching control circuit to break the connection between the first terminal of the inductor and the second voltage supply terminal when a voltage drop across the switching control circuit reaches a threshold voltage.

5. The switching regulator of claim 4, wherein the start cycle control circuit comprises a first comparator coupled to a first one shot for generating a first pulse when the first comparator detects that a first voltage at the first terminal of the inductor is equal to a first supply voltage at the first supply voltage terminal, and wherein the stop cycle control circuit comprises a second comparator coupled to a second one shot for generating a second pulse when the second comparator detects that the first voltage at the first terminal of the inductor is equal to a reference voltage, and wherein the switching control circuit comprises:

a transistor connected between the first terminal of the inductor and the second voltage supply terminal; and an SR latch, wherein an output of the SR latch is connected to a gate of the transistor, wherein the SR latch is configured to turn on and turn off the transistor in response to the first pulse and the second pulse, respectively.

6. The switching regulator of claim 5, wherein an anode of the Schottky diode is connected to the first terminal of the inductor and a cathode of the Schottky diode is connected to the first supply voltage terminal, wherein the first comparator comprises a first non-inverting input connected to the first terminal of the inductor and a first inverting input connected to the first supply voltage terminal, wherein a first output of the first one shot is connected to a set terminal of the SR latch, wherein the second comparator comprises a second non-inverting input connected to the first terminal of the inductor and a second inverting input for receiving the reference voltage, wherein a second output of the second one shot is connected to a reset terminal of the SR latch, and wherein the transistor comprises an NMOS transistor.

7. The switching regulator of claim 6, wherein the transistor has an on resistance, and wherein the reference voltage is equal a product of the on resistance and the predetermined maximum current.

8. The switching regulator of claim 5, wherein an anode of the Schottky diode is connected to the first supply voltage terminal and a cathode of the Schottky diode is connected to the first terminal of the inductor, wherein the first comparator comprises a first non-inverting input connected to the first terminal of the inductor and a first inverting input connected to the first supply voltage terminal, wherein a first output of the first one shot is connected to a reset terminal of the SR latch, wherein the second comparator comprises a second non-inverting input connected to the first terminal of the inductor and a second inverting input for receiving the reference voltage, wherein a second output of the second one shot is connected to a set terminal of the SR latch, and wherein the transistor comprises a PMOS transistor.

9. The switching regulator of claim 8, wherein the transistor has an on resistance, and wherein the reference voltage is equal to a supply voltage at the second supply voltage terminal minus a product of the on resistance and the predetermined maximum current.

10. A method for operating a switching regulator to provide an average current to a load, the switching regulator comprising an inductor connected in series with the load, wherein charging the inductor causes a rising current to flow through the load, and wherein discharging the inductor causes a falling current to flow through the load, the method comprising:

charging the inductor until the rising current is detected to reach a maximum current, the maximum current being substantially equal to twice the average current;

discharging the inductor until the falling current is detected to reach zero; and alternating between the steps of charging and discharging, wherein the step of charging is initiated immediately upon detecting that the falling current reaches zero.

11. The method of claim 10, wherein the step of charging the inductor comprises connecting the inductor to a first supply voltage via a transistor until a voltage drop across the transistor reaches a threshold voltage, wherein a first terminal of the inductor is connected to a first terminal of the load, and wherein a second terminal of the inductor is coupled to a second terminal of the load by a Schottky diode, the Schottky diode being forward biased during the step of discharging, and wherein the step of discharging the inductor comprises connecting the inductor to the first supply voltage when the Schottky diode falls out of forward biasing.

12. The method of claim 11, wherein connecting the inductor to the first supply voltage when the Schottky diode falls out of forward biasing comprises:

comparing a test voltage at a junction between the inductor and the Schottky diode to a second supply voltage coupled to the second terminal of the load; and turning on the transistor when the test voltage reaches the second supply voltage.

13. An electronic circuit comprising:

a first supply voltage terminal for receiving a first supply voltage;

a second supply voltage terminal for receiving a second supply voltage;

a load connected to the first supply voltage terminal;

an inductor, wherein a first terminal of the inductor is connected to the load;

a Schottky diode connected between the first supply voltage terminal and a second terminal of the inductor;

a crossover conduction mode (XCM) control circuit for disconnecting the second terminal of the inductor from the second supply voltage terminal when a current through the inductor is detected to reach a predetermined maximum current, and for immediately connecting the second terminal of the inductor to the second supply voltage terminal when a current through the inductor is detected to reach zero.

14. The electronic circuit of claim 13, wherein the load comprises an LED.

15. The electronic circuit of claim 13, wherein when the current through the inductor is increasing, the Schottky diode is forward biased, and wherein the XCM control circuit comprises:

a switching control circuit for making and breaking a connection between the second terminal of the inductor and the second voltage supply terminal; and a start cycle control circuit for instructing the switching control circuit to make the connection between the second terminal of the inductor and the second voltage supply terminal when the Schottky diode falls out of forward biasing.

16. The electronic circuit of claim 15, wherein the XCM control circuit further comprises a stop cycle control circuit for instructing the switching control circuit to break the connection between the second terminal of the inductor and the second voltage supply terminal when a voltage drop across the switching control circuit reaches a threshold voltage.

17. The electronic circuit of claim 16, wherein the start cycle control circuit comprises a first comparator coupled to a first one shot for generating a first pulse when the first comparator detects that a first voltage at the second terminal of the inductor is equal to the second supply voltage, and wherein the stop cycle control circuit comprises a second comparator coupled to a second one shot for generating a second pulse when the second comparator detects that the first voltage at the second terminal of the inductor is equal to a reference voltage, and wherein the switching control circuit comprises:

a transistor connected between the second terminal of the inductor and the second voltage supply terminal; and an SR latch, wherein an output of the SR latch is connected to a gate of the transistor, wherein the SR latch is configured to turn on and turn off the transistor in response to the first pulse and the second pulse, respectively.

18. The electronic circuit of claim 17, wherein an anode of the Schottky diode is connected to the second terminal of the inductor and a cathode of the Schottky diode is connected to the first supply voltage terminal, wherein the first comparator comprises a first non-inverting input connected to the second terminal of the inductor and a first inverting input connected to the first supply voltage terminal, wherein a first output of the first one shot is connected to a set terminal of the SR latch, wherein the second comparator comprises a second non-inverting input connected to the second terminal of the inductor and a second inverting input for receiving the reference voltage, wherein a second output of the second one shot is connected to a reset terminal of the SR latch, and wherein the transistor comprises an NMOS transistor.

19. The electronic circuit of claim 18, wherein the transistor has an on resistance, and wherein the reference voltage is equal a product of the on resistance and the predetermined maximum current.

20. The electronic circuit of claim 17, wherein an anode of the Schottky diode is connected to the first supply voltage terminal and a cathode of the Schottky diode is connected to the second terminal of the inductor, wherein the first comparator comprises a first non-inverting input connected to the second terminal of the inductor and a first inverting input connected to the first supply voltage terminal, wherein a first output of the first one shot is connected to a reset terminal of the SR latch, wherein the second comparator comprises a second non-inverting input connected to the second terminal of the inductor and a second inverting input for receiving the reference voltage, wherein a second output of the second one shot is connected to a set terminal of the SR latch, and wherein the transistor comprises a PMOS transistor.

21. The electronic circuit of claim 20, wherein the transistor has an on resistance, and wherein the reference voltage is equal to the second voltage minus a product of the on resistance and the predetermined maximum current.

* * * * *